US007313356B2

(12) United States Patent
Koyama

(10) Patent No.: US 7,313,356 B2
(45) Date of Patent: Dec. 25, 2007

(54) IMAGE FORMING APPARATUS

(75) Inventor: Tetsu Koyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 134 days.

(21) Appl. No.: 11/257,132

(22) Filed: Oct. 25, 2005

(65) Prior Publication Data

US 2007/0092315 A1 Apr. 26, 2007

(51) Int. Cl.
*G03G 21/00* (2006.01)

(52) U.S. Cl. ..... 399/349; 399/346; 399/350; 399/357; 399/358

(58) Field of Classification Search ..... 399/346, 399/349, 350, 357, 358
See application file for complete search history.

(56) References Cited

U.S. PATENT DOCUMENTS

2002/0081130 A1* 6/2002 Endo et al. ..... 399/349
2003/0053831 A1* 3/2003 Maeshima et al. ..... 399/349
2004/0062568 A1* 4/2004 Nukada et al. ..... 399/353
2005/0084304 A1* 4/2005 Kataoka et al. ..... 399/346

FOREIGN PATENT DOCUMENTS

JP 2000-259057 9/2000

* cited by examiner

*Primary Examiner*—David M. Gray
*Assistant Examiner*—Ryan D. Walsh
(74) *Attorney, Agent, or Firm*—Rabin & Berdo, PC

(57) ABSTRACT

A cleaning apparatus is used for cleaning the surface of a photoconductive body. Residual toner on a rotating photoconductive body is collected after transferring a toner image from the photoconductive body onto a print medium, the apparatus includes a first cleaning member, a second cleaning member, and a toner transporting member. The first cleaning member engages the photoconductive body to brush away the residual toner. The second cleaning member is disposed downstream of the first cleaning member with respect to rotation of the photoconductive body. The second cleaning member scrapes the residual toner off the photoconductive body. The toner transporting member is disposed between the first cleaning member and the second cleaning member along a circumferential surface of the photoconductive body. The toner transporting member is positioned with a gap between the photoconductive body and the toner transporting member and transporting the residual toner removed from the photoconductive body.

10 Claims, 7 Drawing Sheets

FIG.6

TABLE 1

| Lb (mm) | TONER-TRANSPORTING PERFORMANCE |
|---|---|
| NOT MORE THAN 2 | GOOD |
| 5 | GOOD |
| 10 | GOOD |
| 15 | AVERAGE |
| 20 | POOR |

La=10mm, Lc=15mm

FIG.7

TABLE 2

| La (mm) | Lc (mm) | | | | |
|---|---|---|---|---|---|
| | 2 | 5 | 10 | 15 | 20 |
| 2 | • • • | GOOD | GOOD | GOOD | POOR |
| 5 | GOOD | GOOD | GOOD | GOOD | POOR |
| 10 | GOOD | GOOD | GOOD | GOOD | POOR |
| 15 | GOOD | GOOD | GOOD | AVERAGE | POOR |
| 20 | AVERAGE | AVERAGE | POOR | POOR | POOR |

Lb=10mm

NO DATA FOR La=Lc=2mm, BECAUSE STRUCTURE IS IMPRACTICAL

IMAGE FORMING APPARATUS

BACKGROUND OF THE INVENTION

1. Field of the Invention

The present invention relates to an image forming apparatus such as an electrophotographic recording apparatus, and more particularly to a cleaning apparatus that removes residual toner remaining on a photoconductive body after transfer of a toner image.

2. Description of the Related Art

A conventional electrophotographic recording apparatus uses an electrophotographic image forming process. A charging unit charges the surface of a rotating photoconductive body uniformly. Then, an exposing unit illuminates the charged surface of the photoconductive body in accordance with print data to form an electrostatic latent image. A developing unit supplies toner to the electrostatic latent image to develop the electrostatic latent image into a toner image. A transfer unit transfers the toner image onto a print medium, which in turn is fused into a permanent image in a fixing unit. A cleaning member is provided downstream of a transfer unit with respect to the direction of rotation of the photoconductive body. The developing unit is detachably attached to the image forming apparatus. Additionally, a fresh toner reservoir may be detachably attached to the developing unit.

A small amount of toner remains adhering to the photoconductive body after transferring the toner image onto the print medium. In order to remove the toner from the photoconductive body, a cleaning blade is provided in abutting relation with the photoconductive body. The cleaning blade scrapes the toner from the photoconductive body. The toner scraped by the cleaning blade is held in a residual toner chamber below the cleaning blade. The aforementioned conventional cleaning apparatus requires a relatively large chamber near the photoconductive body for collecting the toner scraped by the cleaning blade. Providing a relatively large chamber for merely holding useless toner is detrimental to miniaturizing the image forming apparatus.

SUMMARY OF THE INVENTION

An object of the invention is to solve the aforementioned drawbacks of the conventional apparatus and to provide an electrophotographic recording apparatus that reliably collects residual toner from the surface of a photoconductive body.

Another object of the invention is to provide a cleaning unit that has the good ability to transport collected toner irrespective of environmental conditions, and that does not cause soiling of a printed medium.

Still another object of the invention is to provide a cleaning unit that can be applied to image forming apparatuses such as copying machines, LED printers, laser beam printers, facsimiles, and MFPs.

A cleaning apparatus is used for cleaning the surface of a photoconductive body. Residual toner on a rotating photoconductive body is collected after transferring a toner image from the photoconductive body onto a print medium. The apparatus includes a first cleaning member, a second cleaning member, and a toner transporting member. The first cleaning member engages the photoconductive body to brush away the residual toner. The second cleaning member is disposed downstream of the first cleaning member with respect to rotation of the photoconductive body. The second cleaning member scrapes the residual toner off the photoconductive body. The toner transporting member is disposed between the first cleaning member and the second cleaning member along a circumferential surface of the photoconductive body. The toner transporting member is positioned with a gap between the photoconductive body and the toner transporting member, and transports the residual toner removed from the photoconductive body.

The first cleaning member rotates about a rotational axis substantially parallel to a first rotational axis of the photoconductive body, and engages the circumferential surface of the photoconductive body to brush away the residual toner. The second cleaning member rotates about a second rotational axis substantially parallel to the rotational axis of the photoconductive body, and engages the circumferential surface of the photoconductive body to scrape the residual toner off the photoconductive body.

The cleaning apparatus further includes an engagement portion. The first cleaning member may be a brush having bristles that engage the circumferential surface of the photoconductive body to brush away the residual toner off the photoconductive body. When the first cleaning member rotates, the engagement portion engages the bristles and then releases the bristles so that the bristles vibrate to shake the residual toner off the bristles.

The first cleaning member, second cleaning member, and toner transporting member are disposed such that $Lb \leqq 15$ mm, $La \leqq 15$ mm, $Lc \leqq 15$ mm, and $La+Lc \leqq 25$ mm where a point "d" and a point "b" are points on the toner transporting member and photoconductive body lying on a line that passes through the centers of the photoconductive body and the toner transporting member, Lb is a line that connects the point "d" and the point "b", Lc is a line that connects the point "d" and a point "c" at which the cleaning blade abuts the photoconductive body, and La is a line that connects the point "d" and a point "a" at which the cleaning blade abuts the photoconductive body.

The cleaning apparatus further includes a solid lubricant disposed such that tip portions of the bristles engage the solid lubricant as the first cleaning member rotates.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 6 illustrates Table 1 that lists the toner-transporting performance for the collected toner;

FIG. 7 illustrates Table 2 that shows in terms of distances La and Lc how efficiently the collected toner is transported;

DETAILED DESCRIPTION OF THE INVENTION

Preferred embodiments will be described in detail with reference to the accompanying drawings.

FIRST EMBODIMENT

Figure 1:
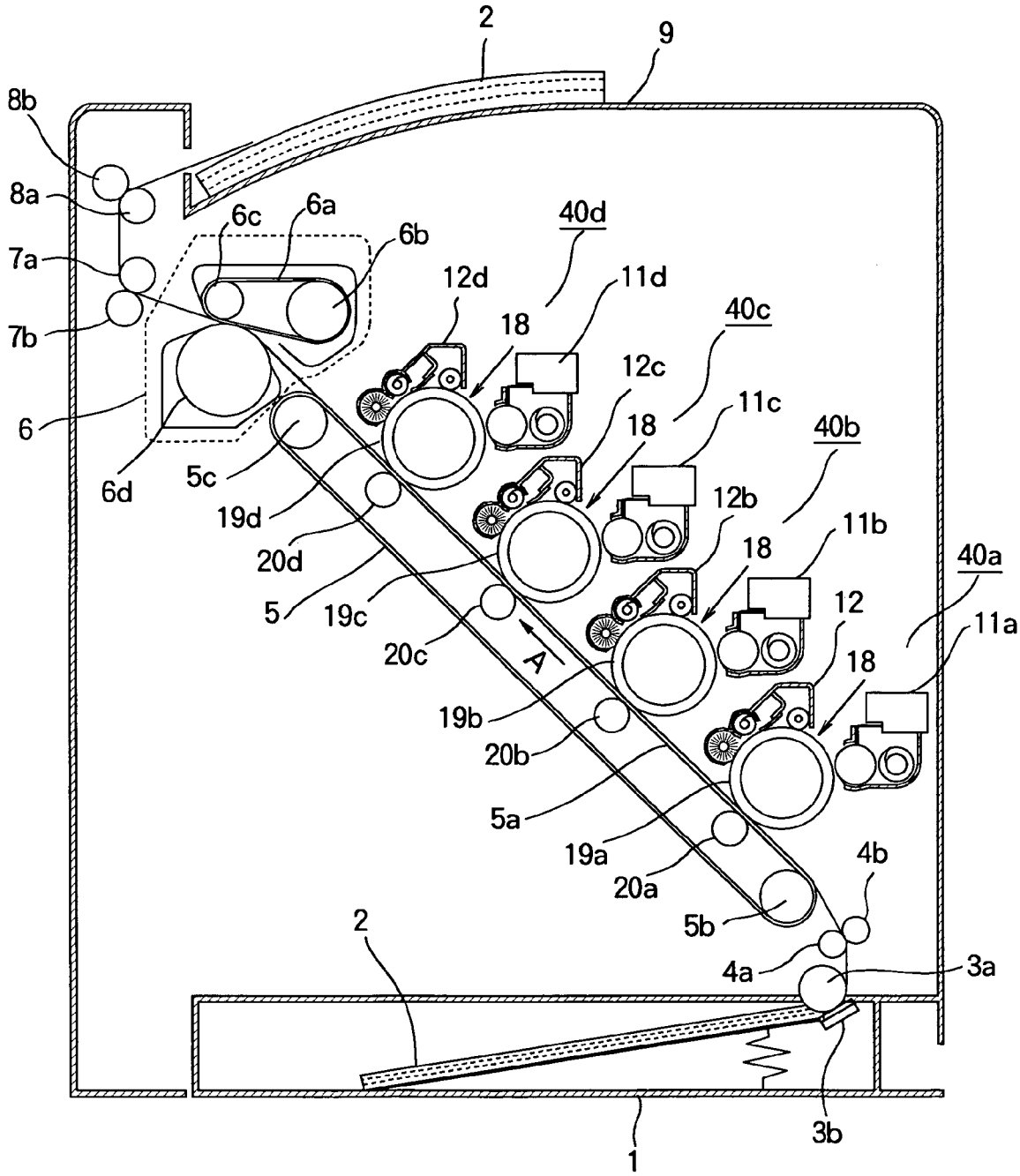
FIG. 1 illustrates an image forming apparatus according to the present invention.

FIG. 1 illustrates an image forming apparatus according to the present invention. Image forming sections 40*a*-40*d* are aligned along a transfer belt 5*a* of a transfer unit 5, and form yellow, magenta, cyan, and black images, respectively. The image forming sections 40*a*-40*d* are aligned from a lower right corner to an upper left corner in such a way that the preceding one of adjacent ones is above the following one of the adjacent ones. The image forming sections 40*a*-40*d* include developing units 11*a*-11*d* and cleaning units 12*a*-12*d*, respectively. Developing rollers of the developing units 11*a*-11*d* are in pressure contact with the photoconductive bodies 19*a*-19*d*, respectively. The cleaning units 12*a*-12*d* abut the photoconductive bodies 19*a*-19*d*, respectively, to collect residual toner from the photoconductive bodies 19*a*-19*d*.

A medium tray 1 holds a stack of medium 2 therein. A separator roller 3*a* cooperates with a separator tongue 3*b* to separate a top page from the stack of medium 2, and feeds the top page to transporting rollers 4*a* and 4*b*. The transporting rollers 4*a* and 4*b* transport the page of medium 2 to the transfer belt 5*a*. The transfer unit 5 includes the transfer belt 5*a*, a drive roller 5*c*, an idle roller 5*b*, and transfer rollers 20*a*-20*d*. The transfer belt 5*a* is entrained about the drive roller 5*c* and the idle roller 5*b*. When the transfer roller 5*c* rotates, the transfer belt 5*a* passes through the image forming sections sequentially in a direction shown by arrow A with the page of medium 2 placed thereon. The transfer rollers 20*a*-20*d* transfer toner images of the respective colors onto the photoconductive bodies 19*a*-19*d*, respectively. A fixing unit 6 includes a heat roller 6*b*, an idle roller 6*c*, and a fixing belt 6*a* entrained about the heat roller 6*b* and idle roller 6*c*, and fixes the toner images transferred onto the page of medium 2. The fixing belt 6*a* is held between the idle roller 6*c* and the pressure roller 6*d* in a sandwiched relation. A heater may be used to heat the idle roller 6*c*. The page of medium 2 leaves the fixing unit and is discharged to a stacker 9 by discharge rollers 7*a*, 7*b*, 8*a*, and 8*b*.

Figure 2:
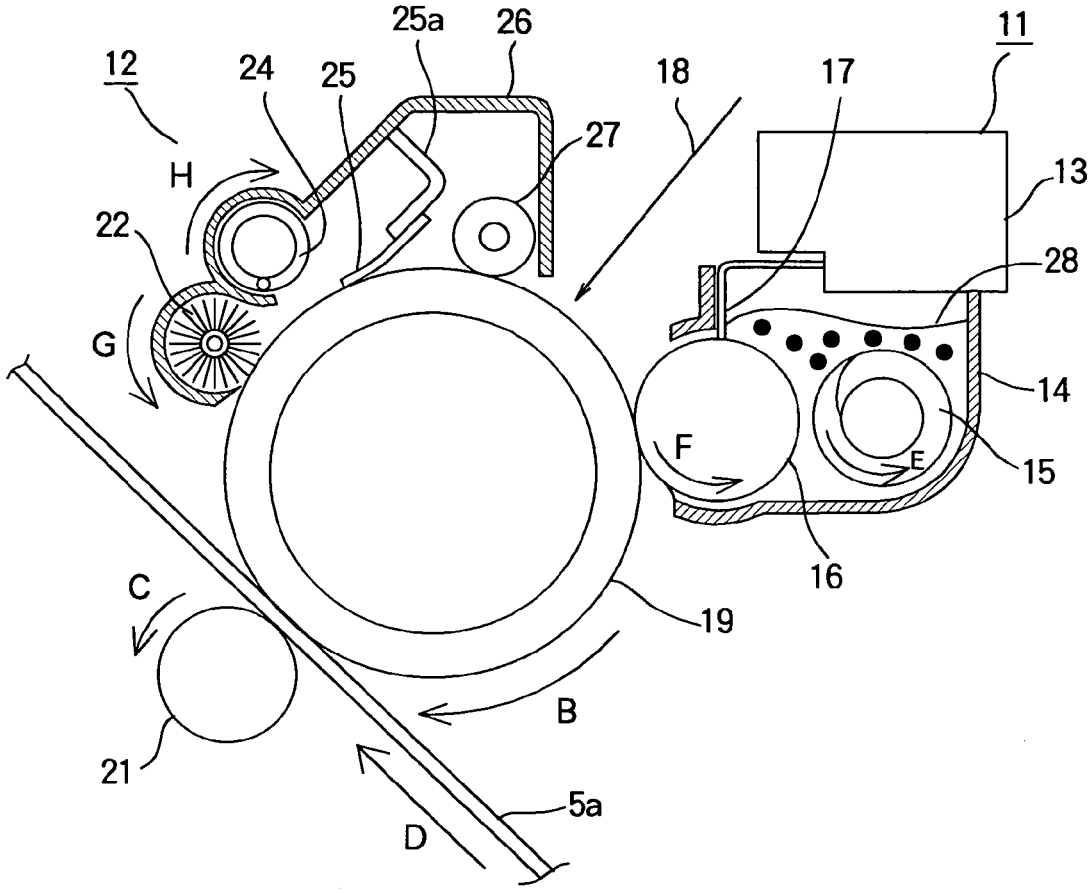
FIG. 2 illustrates the positional relationships among a cleaning brush, a toner transporting member, and a cleaning blade according to a first embodiment.
Figure 3:
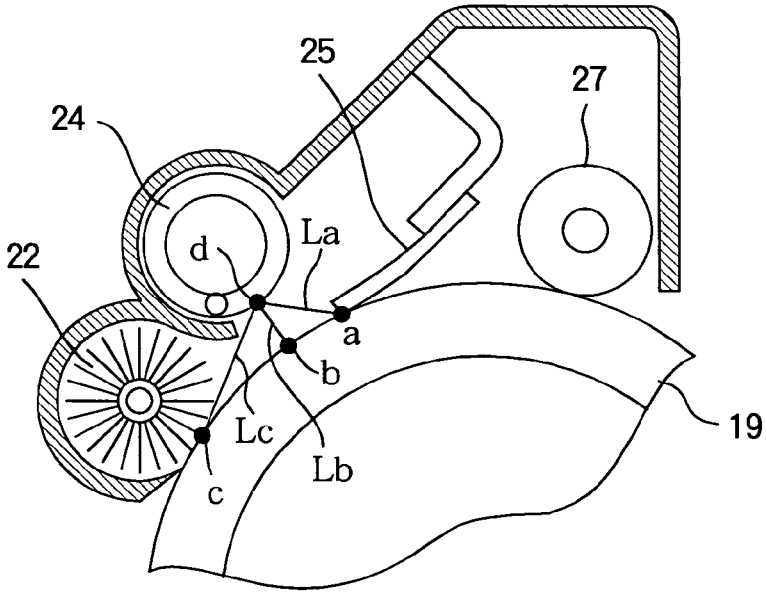
FIG. 3 illustrates a cleaning unit according to the first embodiment.

Referring to FIG. 2, a cleaning brush 22, a toner transporting member 24, and a cleaning blade 25 are disposed along the circumferential surface of the photoconductive body 19. The developing unit 11 includes a housing 14, a toner chamber 13, a toner transporting member 15, and a developing roller 16. The toner 15 is a screw conveyor that extends in its longitudinal direction, and transports the toner from the middle of the developing unit 11 to the ends of the developing unit 11. The developing roller 16 supplies fresh toner 28 to the photoconductive body 19. A developing blade 17 forms a thin layer of fresh toner 28 on the surface of the developing roller 16.

The photoconductor body 19 extends in its longitudinal direction parallel to its rotational axis. A drive force is transmitted to the photoconductive body 19 through a gear 19*g* (FIG. 4) mounted to one longitudinal end portion of the photoconductive body 19, so that the photoconductive body 19 rotates in a direction shown by arrow B. The transfer roller 21 is disposed in such a way that the transfer belt 5*a* is held between the transfer roller 21 and the photoconductive body 19 in a sandwiched relation. The photoconductive body 19 and transfer roller 21 rotate in directions shown by arrows B and C, respectively, so that when the transfer belt 5*a* runs in a direction shown by arrow D, the toner image is transferred from the photoconductive body 19 onto the page of medium 2 placed on the transfer belt 5*a*.

The cleaning units 12*a*-12*d* abut the photoconductive bodies 19*a*-9*d*, respectively, to collect the residual toner from the photoconductive bodies 19*a*-9*d*. The cleaning brush 22 is made from, for example, nylon, and has bristles whose free ends engage the photoconductive body 19. The cleaning brush 22 extends in its longitudinal direction, which is parallel to a rotational axis of the cleaning brush 22, and has a gear 22*g* (FIG. 4) mounted to one longitudinal end of the cleaning brush 22. The gear 22*g* is in mesh with the gear 19*g* of the photoconductive body 19. The toner transporting member 24 is, for example, a coil of stainless steel, and is disposed with a predetermined gap between the photoconductive body 19 and the toner transporting member 24. The toner transporting member 24 extends in its longitudinal direction, which is parallel to a rotational axis of the toner transporting member 24. The toner transporting member 24 includes a gear 24*g* (FIG. 4), which in turn is in mesh with the gear 22*g* of the cleaning brush 22. The cleaning blade 25 is made of a resilient material such as urethane, and its one end abuts the photoconductive body 19. A sheet metal member 25*a* (FIG. 2) supports the cleaning blade 25 in position. A charging roller 27 rotates in contact with the surface of the photoconductive body 19, and charges the photoconductive body 19. A cover 26 defines an outer wall that encloses the cleaning brush 22, cleaning blade 25, charging roller 27, and toner transporting member 24. The cover 26 includes a rib 26*b* (FIG. 10) that projects in such a way that the rib 26*b* abuts the tip portions of bristles of the cleaning brush 22. The rib 26*b* extends in its longitudinal direction, which is parallel to the length of the cleaning brush 22.

The cleaning brush 22, cleaning blade 25, toner transporting member 24, and photoconductive body 19 are disposed such that $Lb \leqq 10$ mm, $La \leqq 15$ mm, $Lc \leqq 15$ mm, and $La+Lc \leqq 25$ mm where a point "d" and a point "b" are points on the toner transporting member 24 and photoconductive body 19 lying on a line that passes through the centers of the photoconductive body 19 and the toner transporting member 24, Lb is a line that connects the point "d" and the point "b," Lc is a line that connects the point "d" and a point "c" at which the cleaning brush 22 abuts the photoconductive body 19, and La is a line that connects the point "d" and a point "a" at which the cleaning blade 25 abuts the photoconductive body 19.

When the image forming apparatus receives a printing command from an external apparatus, not shown, the separator roller 3*a* cooperates with the separator tongue 3*b* to separate a top page of medium 2, and feeds it to the transport rollers 4*a* and 4*b*. The transport rollers 4*a* and 4*b* transport the page of medium 2 to the transfer belt 5*a*, which in turn runs through the respective image forming sections with the page placed thereon. At this moment, the exposure light 18 illuminates the charged surfaces of the photoconductive bodies 19*a*-19*d* in accordance with print data. The potential of the areas on the photoconductive bodies exposed to the exposure light 18 decreases to nearly zero volts.

The toner transporting member 15 in the developing unit 11 is rotated by a drive source, not shown, in a direction shown by arrow E, thereby supplying the toner to the developing roller 16. The developing blade 17 forms a thin layer of toner on the developing roller 16 and causes the toner to be charged. Because the photoconductive body 19 continues to rotate, the thin layer of toner on the developing roller 16 is attracted to the exposed areas on the photoconductive body 19 so that the electrostatic latent image on the photoconductive body 19 is developed into a toner image.

This toner image is transferred by the transfer roller 21 onto the page of medium 2 that is being transported by the transfer belt 20 in the D direction. Then, the medium 2 is transported to the fixing unit 6 where the toner image is fused into a permanent image. The medium 2 is discharged by the transport rollers 7*a*, 7*b*, 8*a*, and 8*b* onto a stacker 9 provided on the outer surface of the image forming apparatus.

Figure 4:
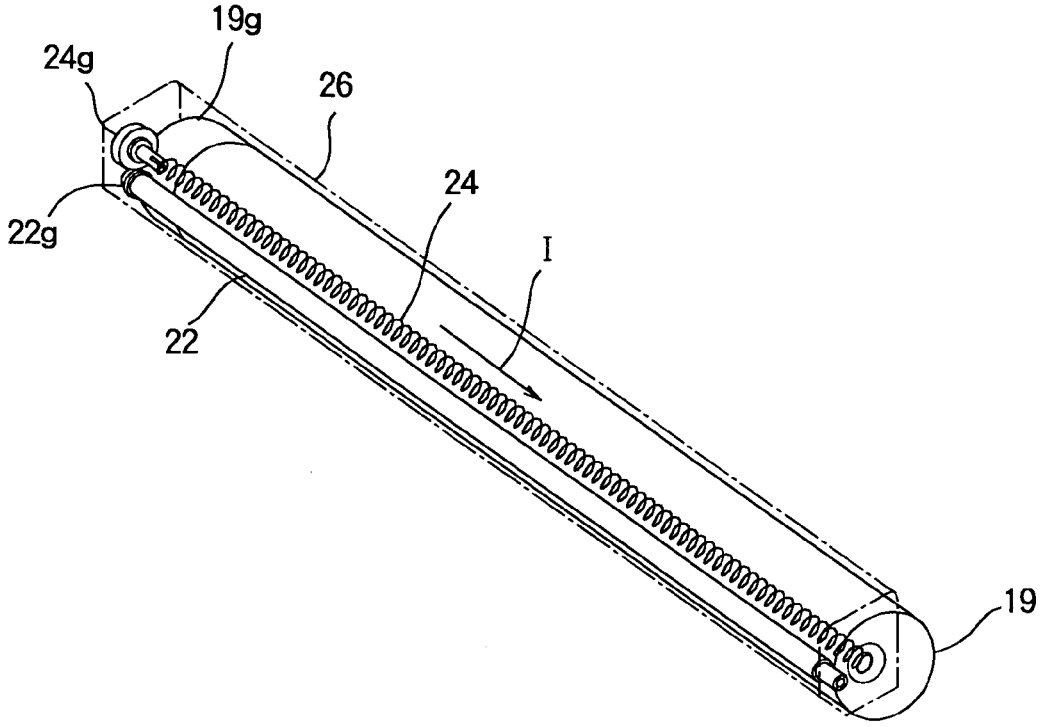
FIG. 4 is a perspective view illustrating the positional relationship between a cleaning brush and a toner transporting member.

FIG. 4 is a perspective view illustrating the positional relationship between the cleaning brush 22 and the toner transporting member 24. After transferring the toner image onto the page of medium 2, a small amount of toner remains on the photoconductive body 19. The drive force is transmitted to the cleaning brush 22 through the gear 22*g*, and drives the cleaning brush 22 to rotate in a direction shown by arrow G (FIG. 2), so that the cleaning brush 22 brushes away the residual toner on the photoconductive body 19. The circumferential speed of the cleaning brush 22 is selected to be the same as or greater than that of the photoconductive body 19. The cleaning blade 25 is in pressure contact with the surface of the photoconductive body 19 to scrape the residual toner from the photoconductive body 19. A drive force is transmitted to the toner transporting member 24 through the gear 24*g*, and drives the toner transporting member 24 to rotate in a direction shown by arrow H (FIG. 2), so that the toner transporting member 24 transports the residual toner removed from the photoconductive body 19 in a direction shown by arrow I. Then, the collected residual toner is discharged through an outlet.

Figure 5:
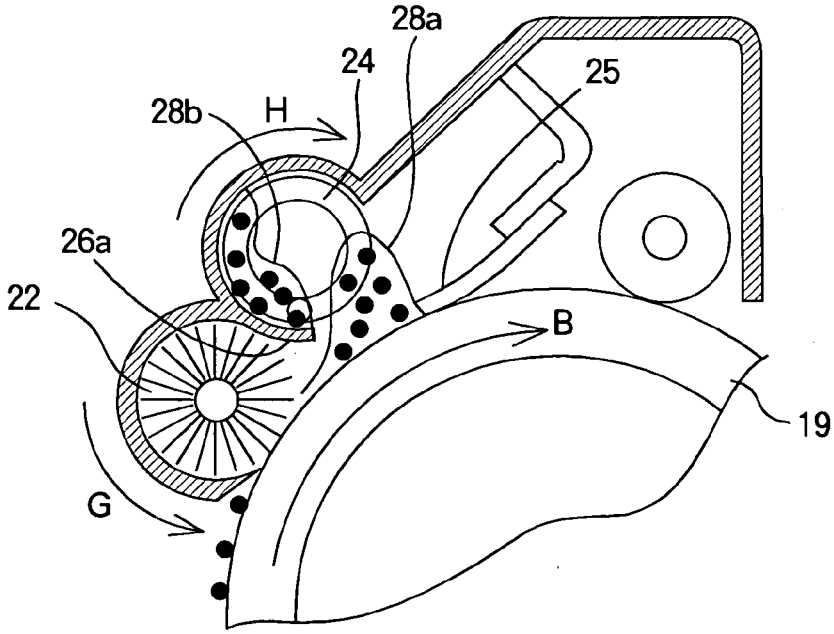
FIG. 5 illustrates the cleaning unit in detail.

FIG. 5 illustrates the cleaning unit 12 in detail. The cleaning brush 22 and cleaning blade 25 remove residual toner 28*a* from the photoconductive body 19. The residual toner 28*a* removed from the photoconductive body 19 stays in a space between the toner transporting member 24 and cleaning blade 25. When the toner transporting member 24 rotates in the H direction, part of the residual toner 28*a* moves to a rib 26*a* that projects into a space enclosed by the cover 26, and is discharged as a collected toner 28*b* through an outlet. In other words, the toner transporting member 24 transports the residual toner 28*a* so that the residual toner 28*a* will not accumulate in the space between the toner transporting member 24 and the cleaning blade 25.

FIG. 6 illustrates Table 1 that lists the toner-transporting performance for the collected toner 28*b*. The performance was evaluated by printing at a print duty of 5% and causing the photoconductive body to make 30,000 rotations. "Good" represents a satisfactory result irrespective of environmental conditions. "Poor" indicates that the toner fails to be properly collected and causes poor cleaning results and hence soiling of printed results (not dependent on the environmental conditions). "Average" indicates that the toner fails to be collected when the apparatus operates in a high-temperature and high humidity (28° C., 80%) environment, causing poor cleaning results and hence poor print quality. Table 1 reveals that for Lb not more than 10 mm, good toner transporting performance is obtained and no soiling of printed results occurs in any environmental conditions at which the cleaning unit operates.

FIG. 7 illustrates Table 2 that shows in terms of La and Lc how efficiently the collected toner 28*b* is transported. Table 2 shows that good toner transporting performance can be obtained irrespective of the environmental conditions for $Lb \leqq 10$ mm, $La \leqq 15$ mm, $Lc \leqq 15$ mm, and $La+Lc \leqq 25$ mm. The cleaning apparatus takes less volume than prior art apparatus, lending itself to the miniaturization of the image forming apparatus. Polymerization toner has a relatively small diameter and therefore a high cleaning performance is required of a cleaning apparatus. Thus, the present invention can be applicable to apparatuses that use polymerization toner, lending itself to high cleaning performance.

SECOND EMBODIMENT

Figure 8:
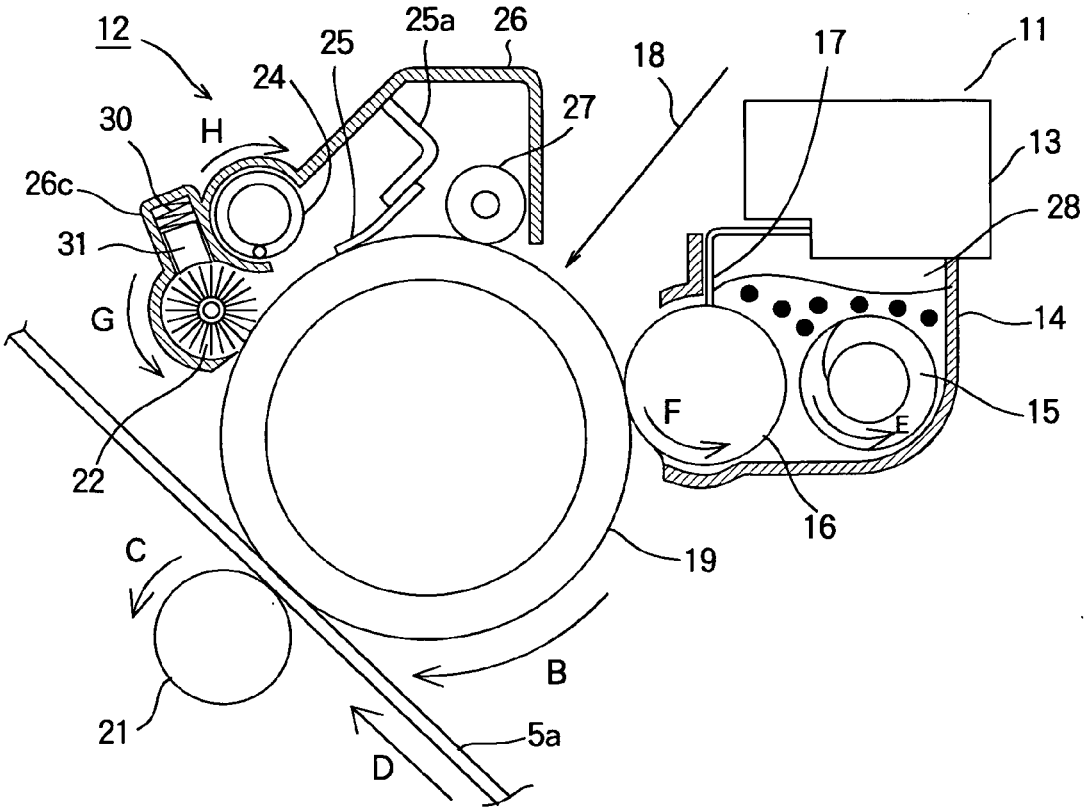
FIG. 8 is a side view illustrating the cleaning unit and a developing unit according to a second embodiment.

FIG. 8 is a side view illustrating the cleaning unit and the developing unit according to a second embodiment. The toner transporting member 24 and a mounting portion 26*c* that accommodates a solid lubricant 31 are disposed to surround the cleaning brush 22. The mounting portion 26*c* is downstream of the toner transporting member 24 with respect to a direction shown by arrow G, i.e., the direction of rotation of the cleaning brush 22. The mounting portion 26*c* accommodates the solid lubricant 31 and a resilient member 30 therein. The resilient member 30 urges the lubricant 31 against the tips of the bristles of the cleaning brush 22. The lubricant 31 is made by first melting a lubrication oil additive that contains zinc stearate as a major component, and then cooling it to a solid state. The rest of the configuration of the second embodiment is the same as that of the first embodiment and the description thereof is omitted.

Figure 9:
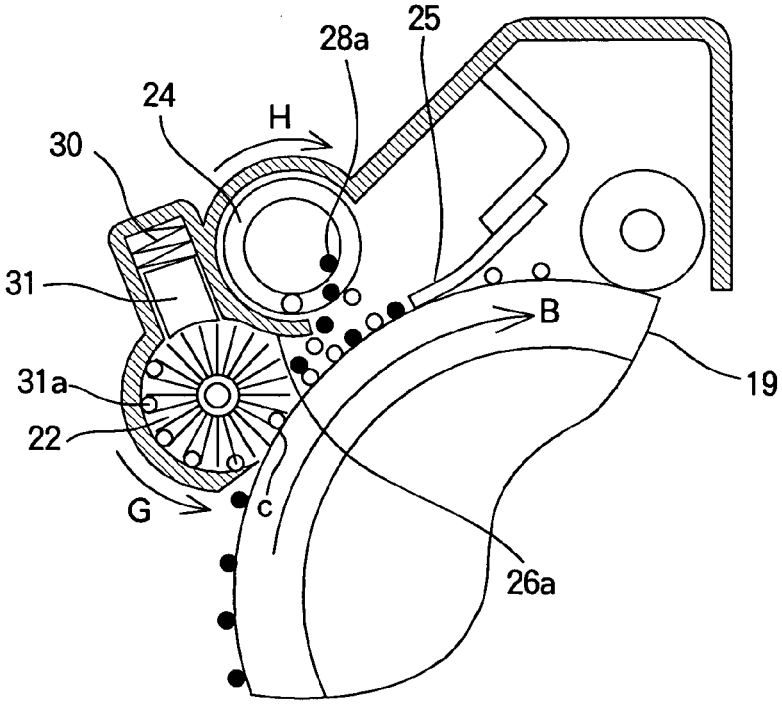
FIG. 9 illustrates a pertinent portion of a cleaning unit according to the second embodiment.

FIG. 9 illustrates a pertinent portion of a cleaning unit according to a second embodiment. Referring to FIG. 9, fine particles 31*a* of the lubricant 31 adhere to the bristles of the cleaning brush 22. The cleaning brush 22 supplies an amount of the fine particles 31*a* to the surface of the photoconductive body 19 at a point upstream of the contact point "c," and removes the residual toner 28*a* from the photoconductive body 19 at a point downstream of the contact point "c." The fine particles 31*a* adhering to the photoconductive body 19 are not thoroughly scraped off the photoconductive body 19 by the cleaning blade 25 but a small amount of the fine particles 31*a* remains on the photoconductive body 19. The rest of the operation of the second embodiment is the same as that of the first embodiment and the description thereof is omitted.

The fine particles 31*a* deposited on the surface of the photoconductive body 19 serve to decrease the friction on the surface f the photoconductive body 19, facilitating easy removal of the residual toner from the photoconductive body 19. The lubricant 31 is disposed downstream of the toner transporting member 24 with respect to the G direction. Thus, after the cleaning brush 22 has pushed the residual toner 28*a* removed from the photoconductive body 19 toward the toner transporting member 24, the lubricant 31 adheres to the tip portions of the bristles of the cleaning brush 22. For this reason, the removed residual toner 28*a* will not stay at a location where the lubricant 31 is disposed. Thus, the lubricant 31 can be easily supplied to the surface of the photoconductive body 19. The residual toner 28*a* is apt to adhere to the bristles of the cleaning brush 22 in the vicinity of the surface of the photoconductive body 19. Therefore, the lubricant 31 is disposed as away from the surface of the photoconductive body 19 as possible so that the residual toner 28*a* will not adhere to the bristles but the particles of the lubricant 31 will adhere. In this manner, some uniform amount of the lubricant 31 can be supplied to the photoconductive body 19 constantly. The rest of the advantages of the second embodiment are the same as those of the first embodiment and the description thereof is omitted.

THIRD EMBODIMENT

Figure 10:
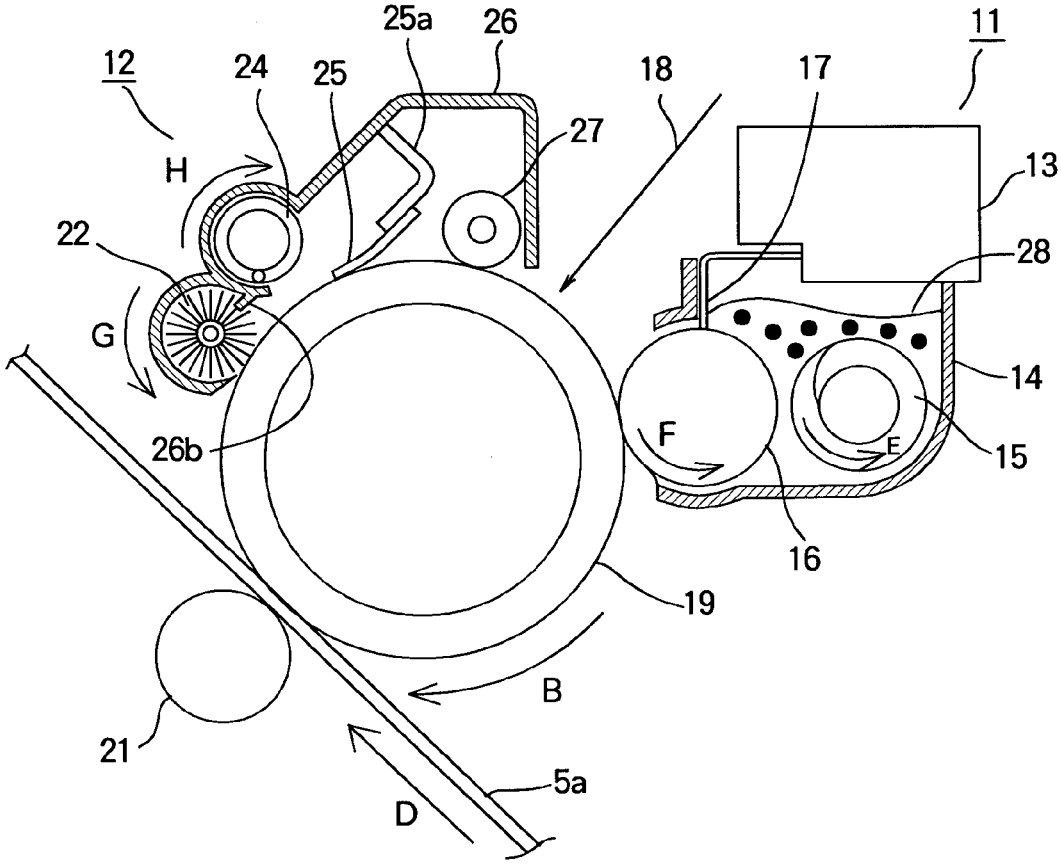
FIG. 10 is a side view illustrating a cleaning unit and a developing unit according to a third embodiment.

FIG. 10 is a side view illustrating a cleaning unit and a developing unit according to a third embodiment. Referring to FIG. 10, a flicker 26*b* is located downstream with respect to the rotation of the cleaning brush 22 at a point at which a cleaning brush 22 engages a photoconductive body 19. The flicker 26*b* is provided on a part of a cover 26, and extends in its longitudinal direction, which is parallel to the rotational axis of the cleaning brush 22. The length of the flicker 26*b* is the same as or longer than the cleaning brush 22. The flicker 26*b* is positioned so that when the cleaning brush 22 rotates, the flicker 26*b* can engage the tip portions of the bristles of the cleaning brush 22 or enter into the bristles. When the cleaning brush 22 rotates, the flicker 26*b* interferes with the tip partitions of the bristles, causing the bristles to first flex resiliently and then releasing the bristles so that the bristles vibrate to shake the toner particles off the bristles. The rest of the configuration of the third embodiment is the same as that of the first embodiment and the description thereof is omitted.

Figure 11:
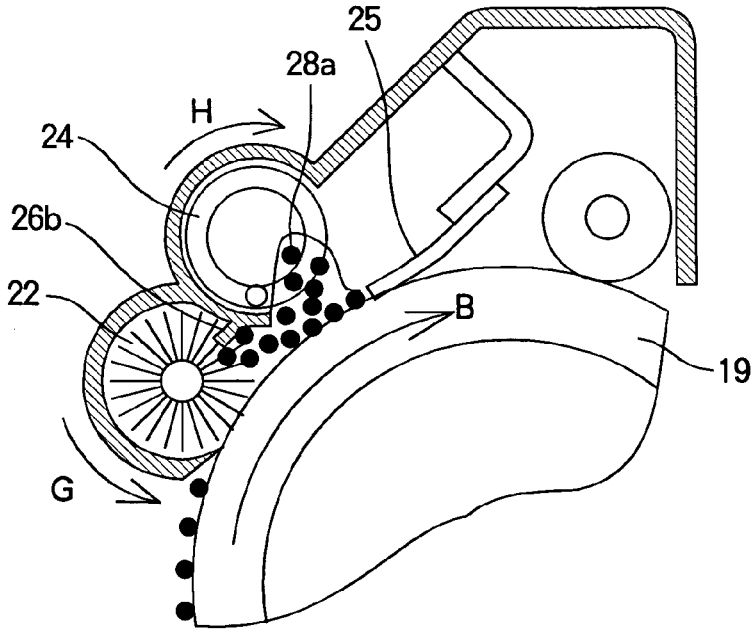
FIG. 11 illustrates a pertinent portion of the cleaning unit according to the third embodiment.

FIG. 11 illustrates a pertinent portion of the cleaning unit according to the third embodiment. Referring to FIG. 11, the cleaning brush 22 engages the surface of the photoconductive body 19 to brush away the residual toner 28*a* on the photoconductive body 19. Because the flicker 26*b* engages the tip portions of the bristles of the cleaning brush 22, the toner can be brushed away even though the residual toner adheres to the tip portions of the bristles or enters into the bristles. Thus, the toner particles will not be trapped among the bristles or remain adhered to the bristles, not deteriorating the ability of the bristles to brush away the residual toner 28*a* from the surface of the photoconductive body 19. The rest of operation and advantages are the same as those of the first embodiment.

Figure 12:
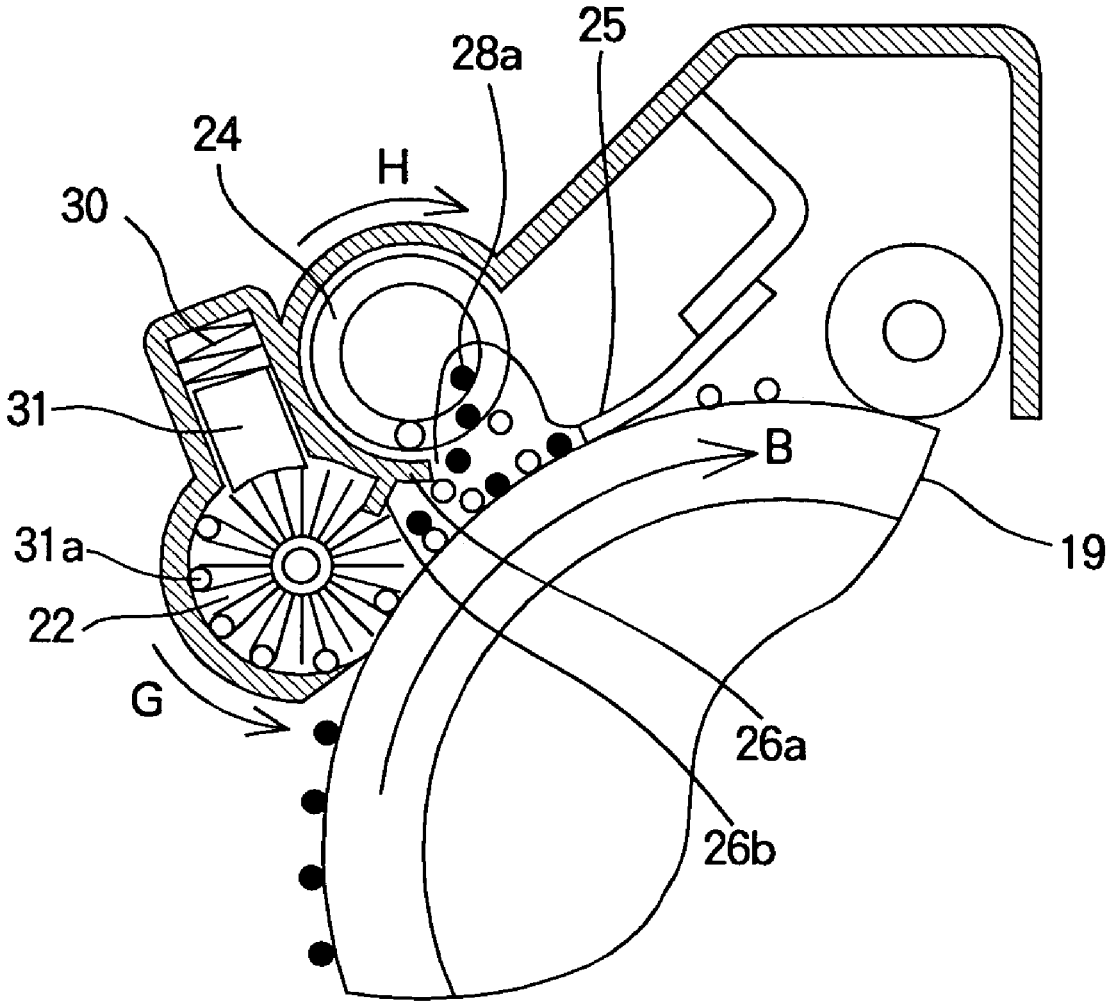
FIG. 12 illustrates a pertinent portion of a modification to the third embodiment.

FIG. 12 illustrates a pertinent portion of a modification of the third embodiment. This modification is a combination of the configuration of the third embodiment and the mounting portion 26*c*, solid lubricant 31, and the resilient member 30 of the second embodiment. The rest of the operation and advantages of the modification is the same as those of the second and third embodiments and the description thereof is omitted. The present invention is applicable to an image forming apparatus used in, for example, a copying machine, an LED printer, a laser beam printer, a facsimile machine, and an MFP.

What is claimed is:

1. An image forming apparatus in which residual toner on a rotating photoconductive body is collected after transferring a toner image from the photoconductive body onto a print medium, the apparatus comprising:

a first cleaning member that rotates in a first direction, the first cleaning member extending substantially in parallel with the photoconductive body and engaging the photoconductive body to collect the residual toner;

a second cleaning member disposed downstream of the first cleaning member with respect to rotation of the photoconductive body, the second cleaning member scraping the residual toner off the photoconductive body;

a toner transporting member disposed between the first cleaning member and the second cleaning member and extending substantially in parallel with the photoconductive body, the toner transporting member being positioned with a first gap between the photoconductive body and the toner transporting member and rotating in a second direction opposite to the first direction; and a partitioning wall positioned between the first cleaning member and the toner transporting member, and extending substantially in parallel with the photoconductive body with a second gap between the photoconductive body and the partitioning wall;

wherein the first cleaning member rotates to guide the residual toner through the second gap toward the toner transporting member, and the toner transporting member cooperates with the partitioning wall to collect the residual toner received through the second gap and the residual toner scraped by the second cleaning member.

2. The image forming apparatus according to claim 1, wherein the first cleaning member rotates about a rotational axis substantially parallel to a first rotational axis of the photoconductive body and engages the circumferential surface of the photoconductive body to brush away the residual toner, and wherein the second cleaning member is a cleaning blade that engages the circumferential surface of the photoconductive body.

3. The image forming apparatus according to claim 2, wherein the first cleaning member, second cleaning member, and toner transporting member are disposed such that $Lb \leqq 15$ mm, $La \leqq 15$ mm, $Lc \leqq 15$ mm, and $La+Lc \leqq 25$ mm where a point "d" and a point "b" are points on the toner transporting member and photoconductive body and lying on a line on a line that passes through the centers of the photoconductive body and the toner transporting member, Lb is a line that connects the point "d" and the point "b," Lc is a line that connects the point "d" and a point "c" at which the first cleaning member abuts the photoconductive body, and La is a line that connects the point "d" and a point "a" at which the second cleaning member abuts the photoconductive body.

4. The image forming apparatus according to claim 2, further comprising an engagement portion, wherein the first cleaning member is a brush having bristles that engage the circumferential surface of the photoconductive body to brush away the residual toner off the photoconductive body, and wherein, when the first cleaning member rotates, the engagement portion engages the bristles and then releases the bristles so that the bristles vibrate to shake the residual toner off the bristles.

5. The image forming apparatus according to claim 1, further comprising an engagement portion, wherein the first cleaning member is a brush having bristles, and wherein when the first cleaning member rotates, the engagement portion engages the bristles such that the bristles vibrate to shake the toner particles off the bristles.

6. The image forming apparatus according to claim 5, further comprising a solid lubricant disposed such that tip portions of the bristles engage the solid lubricant as the first cleaning member rotates.

7. The image forming apparatus according to claim 1, wherein the toner transporting member is rotatable about an axis and the partitioning wall is configured to accommodate a cylindrical contour described by the toner transporting member when the toner transporting member rotates about the axis.

8. The image forming apparatus according to claim 1, wherein the partitioning wall includes an end that extends substantially parallel to the circumstantial surface of the photoconductive body and that extends from upstream to downstream of rotation of the toner transporting member.

9. The image forming apparatus according to claim 1, wherein the partitioning wall includes a rib that projects toward the first cleaning member.

10. The image forming apparatus according to claim 1, wherein the partitioning wall extends under a gravitational end of the toner transporting member.

* * * * *